US006250574B1

(12) United States Patent
Wu Huang

(10) Patent No.: US 6,250,574 B1
(45) **Date of Patent: *Jun. 26, 2001**

(54) DEVICE FOR MONITORING PAPER SHREDDING ACTION OF PAPER SHREDDER

(76) Inventor: Li-Ming Wu Huang, 3F, No. 29, Lane 80, Sec. 1, Dwu Hwu S. Road, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/287,115

(22) Filed: Apr. 7, 1999

(51) Int. Cl.[7] ..... B02C 25/00
(52) U.S. Cl. ..... 241/36; 241/236
(58) Field of Search ..... 241/36, 37.5, 100, 241/236

(56) References Cited

U.S. PATENT DOCUMENTS 3,724,766 * 4/1973 Bosland ..... 241/36
5,167,374 * 12/1992 Strohmeyer ..... 241/36
5,984,215 * 11/1999 Huang ..... 241/36

* cited by examiner

*Primary Examiner*—Mark Rosenbaum

(57) ABSTRACT

A device is intended to monitor the paper shredding action of a paper shredder and composed of two paper guiding grid plates, a microswitch, and a detecting rod. A paper guiding passage is formed between the two grid plates. A first paper guiding grid plate is provided with a fastening seat. The detecting rod is fastened pivotally with the fastening seat such that the detecting rod extends between the two paper guiding grid plates. The microswitch is mounted on the fastening seat such that the microswitch is contiguous to the detecting rod. As the front end of a paper sheet has passed the paper guiding passage, the detecting rod is pushed by the front end of the paper sheet to swivel to trigger the microswitch to activate the shredding tools of the paper shredder.

8 Claims, 4 Drawing Sheets

DEVICE FOR MONITORING PAPER SHREDDING ACTION OF PAPER SHREDDER

FIELD OF THE INVENTION

The present invention relates generally to a paper shredder, and more particularly to a device for sensing the paper shredding action of the paper shredder.

BACKGROUND OF THE INVENTION

The conventional paper shredder is generally provided at the paper entry thereof with a microswitch or LED electric eye for sensing the entry of paper to be shredded so as to trigger the operation of the motor. As the motor is started, the paper shredding tool of the paper shredder is driven by the motor to execute the paper-shredding operation.

Such a conventional paper shredder as described above is defective in design in that the paper shredding action is brought to a halt before the rear end of the paper is shredded. In order to overcome such a deficiency as described above, the conventional paper shredder is provided with a time delay circuit in conjunction with the microswitch or electric eye to enable the shredding tool to continue operating for additional 2–3 seconds after the rear end of the paper has passed the microswitch or electric eye. However, the addition of the delay circuit to the paper shredder results in an increase in cost of making the paper shredder. Moreover, the electronic components are often susceptible to the environmental factors, such as temperature and humidity, which undermine the longevity and the reliability of the delay circuit.

SUMMARY OF THE INVENTION

It is therefore the primary objective of the present invention to provide a paper shredder with a simple and efficient device for sensing the shredding action of the paper shredder, without the use of the expensive and unreliable delay circuit.

It is another objective of the present invention to provide a paper shredder with a relatively reliable device for sensing the shredding action of the paper shredder.

The foregoing objectives of the present invention are attained by a monitoring device which is located under a paper entry of the shredder and composed of two paper guiding grid plates, a microswitch, and a detecting rod. A paper guiding passage is formed between the two grid plates. A first paper guiding grid plate is provided with a fastening seat extending therefrom. The detecting rod is fastened pivotally with the fastening seat such that the detecting rod extends between the two grid plates. The microswitch is mounted on the fastening seat such that the microswitch is contiguous to the detecting rod. As the front end of a paper sheet has passed the paper guiding passage, the detecting rod is pushed by the front end of the paper to swivel to trigger the microswitch. As a result, the shredding tools remain in operation.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
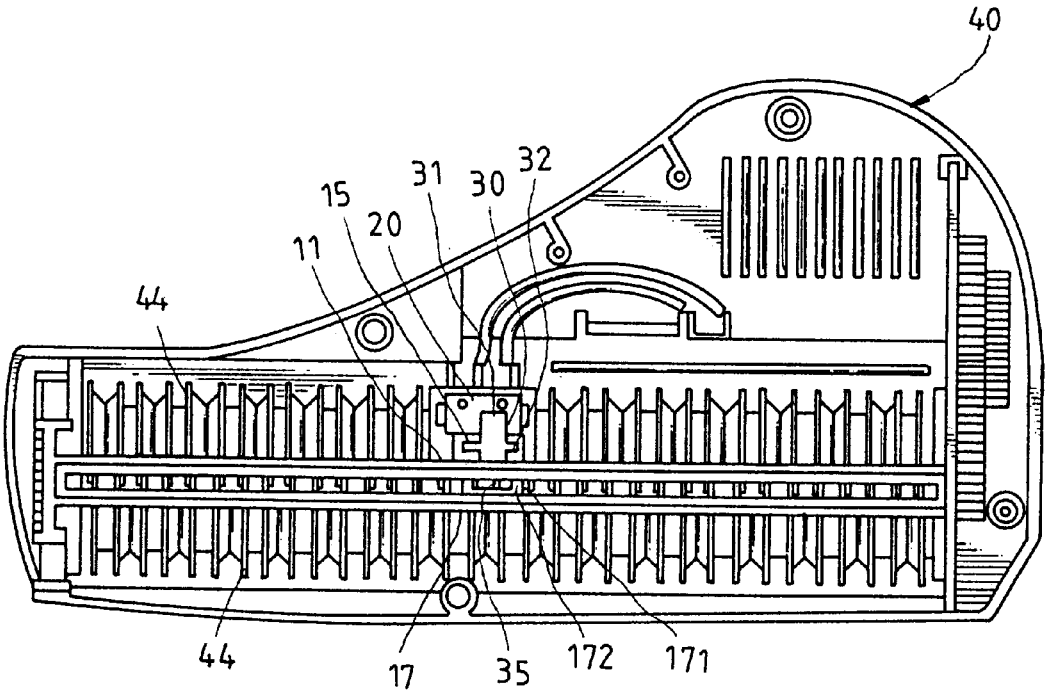
FIG. 1 shows a schematic view of the present invention in conjunction with a paper shredder.
Figure 2:
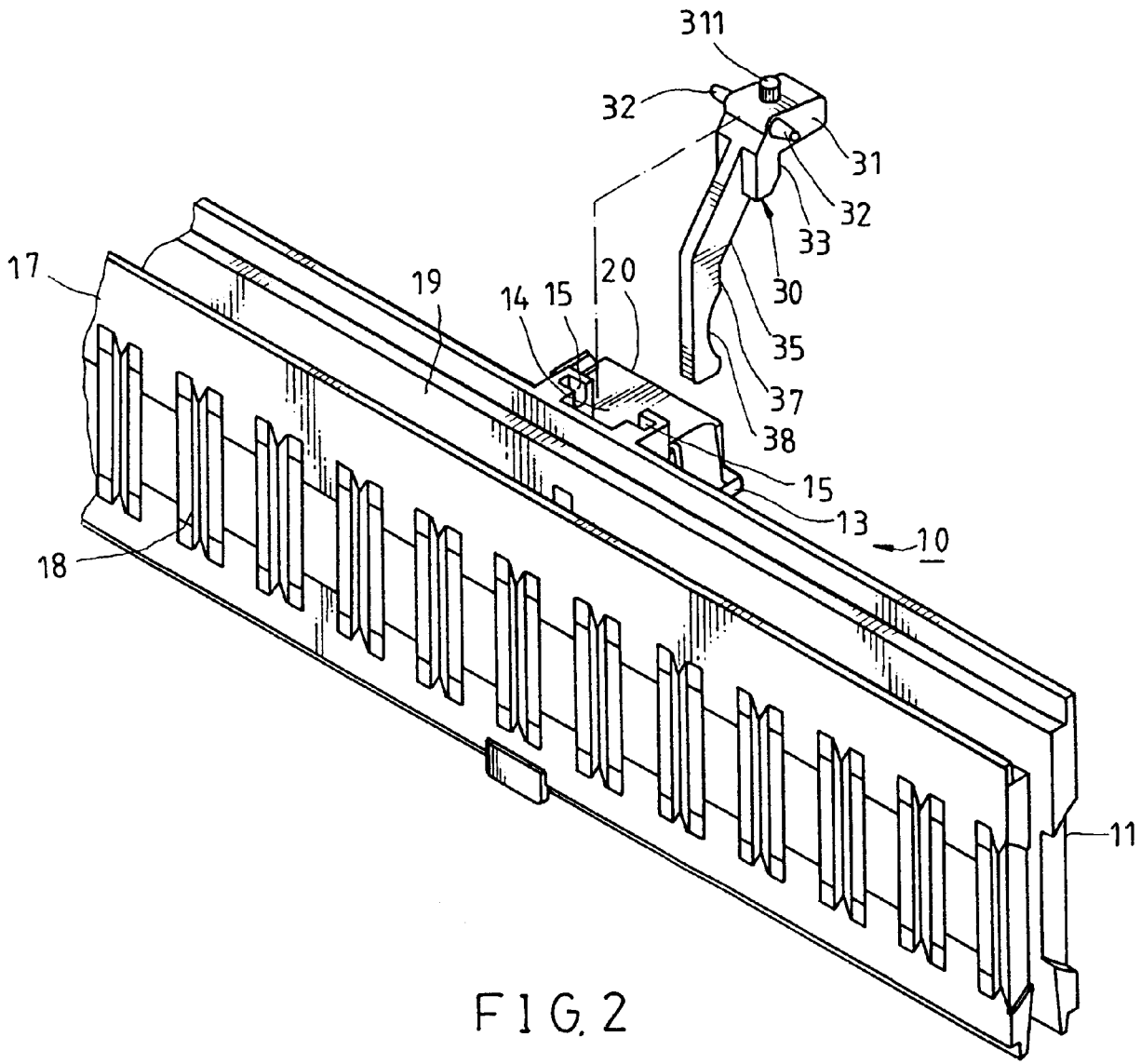
FIG. 2 shows a partial exploded view of the present invention.
Figure 3:
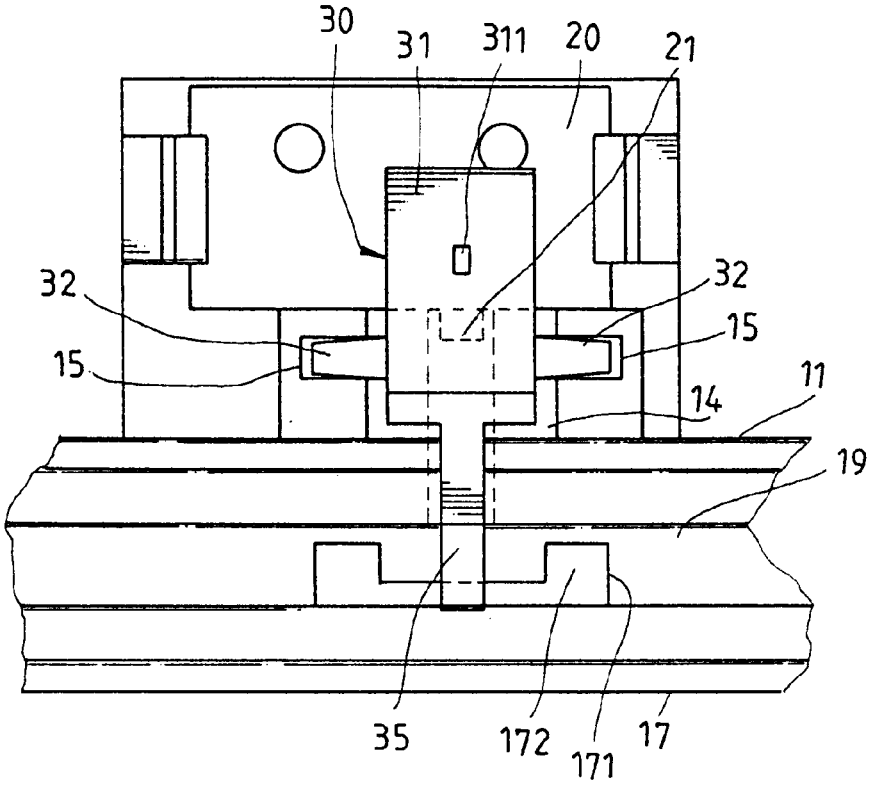
FIG. 3 shows a top view of the present invention in combination.

As shown in FIGS. 1–3, a paper-shredding action sensor 10 embodied in the present invention is intended for use in a paper shredder and composed mainly of two paper guiding grid plates 11 and 17, a microswitch 20, and a detecting rod 30. The sensor 10 is located under a paper entry 42 of a base 40 of the paper shredder.

The two paper-guiding grid plates 11 and 17 are provided with a plurality of through holes 18 through which two paper shredding tools 44 are inserted from the outer sides of the two grid plates 11 and 17 such that a paper guiding passage 19 is formed between the two grid plates 11 and 17 for guiding the paper into a position located between the two shredding tools 44.

As shown in FIG. 2, the first paper-guiding grid plate 11 is provided with a fastening seat 13, which is extended therefrom and provided in the top thereof with a recess 14 in communication with the first paper guiding grid 11 and the paper guiding passage 19. The fastening seat 13 is further provided in the top thereof with two receiving slots 15. The second paper guiding grid plate 17 is provided with a guide portion 171 corresponding in location to one side of the paper guiding passage 19. The guide portion 171 is provided with an inclined plane 172 opposite to the top end of the paper guiding passage 19.

The microswitch 20 is of a prior art structure and is mounted on the fastening seat 13. The microswitch 20 has a contact button 21 extending into the recess 14. As the contact button 21 is touched, it sends out the signal to activate the two shredding tools 44.

The detecting rod 30 has a head 31 which is provided with two lugs 32 extending from two sides thereof, a press surface 33 located in the lower side thereof, and an inclined portion 35 extending from the bottom thereof. The inclined portion 35 is provided with a vertical portion 37 extending downward and vertically from one end thereof. The two lugs 32 are received in the two receiving slots 15 such that the two lugs 32 serve as pivots on which the detecting rod 30 swivels back and forth in the recess 14. The inclined portion 35 is located in the recess 14. The vertical portion 37 is located in the paper guiding passage 19 such that one end of the vertical portion 37 is located under the lower end point of the intersection surface of the two shredding tools 44. In the meantime, the press surface 33 is corresponding in location to the front of the contact button 21 of the microswitch 20 and is slightly in contact with the contact button 21. When the detection rod 30 swivels, it touches the microswitch 20. The vertical portion 37 is provided with an arcuate surface 38 opposite in location to the first paper guiding grid plate 11. When the detecting rod 30 swivels toward the first paper guiding grid plate 11, the arcuate surface 38 enlarges the distance between the detecting rod 30 and the shredding tool 44 so as to enlarge the swiveling space of the detecting rod 30. The head end 31 of the detecting rod 30 is further provided in the top thereof with a dialing block 311 which is jutted out of the through hole 46 such that it can be dialed with hand.

Figure 7:
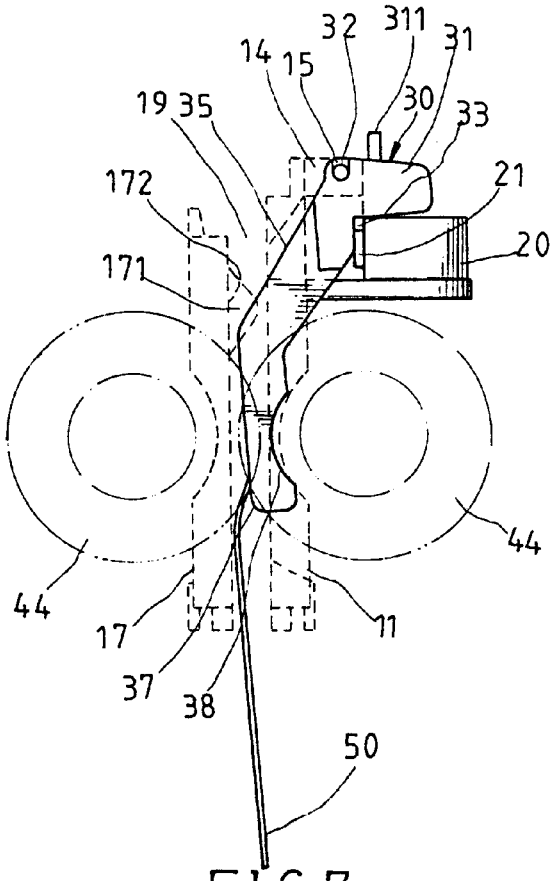
FIG. 7 is a schematic view showing the state of the detecting rod of the present invention at the time when the paper has been completely shredded.
Figure 4:
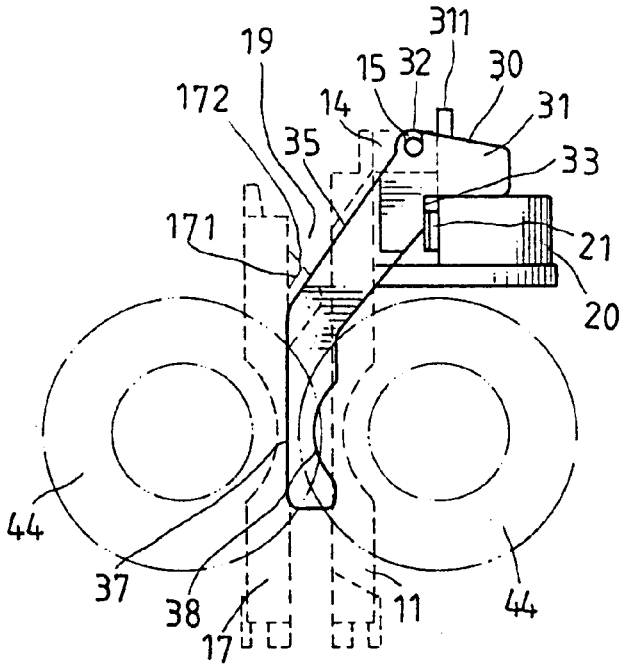
FIG. 4 is a schematic view of the action of the present invention before paper is fed thereinto.
Figure 5:
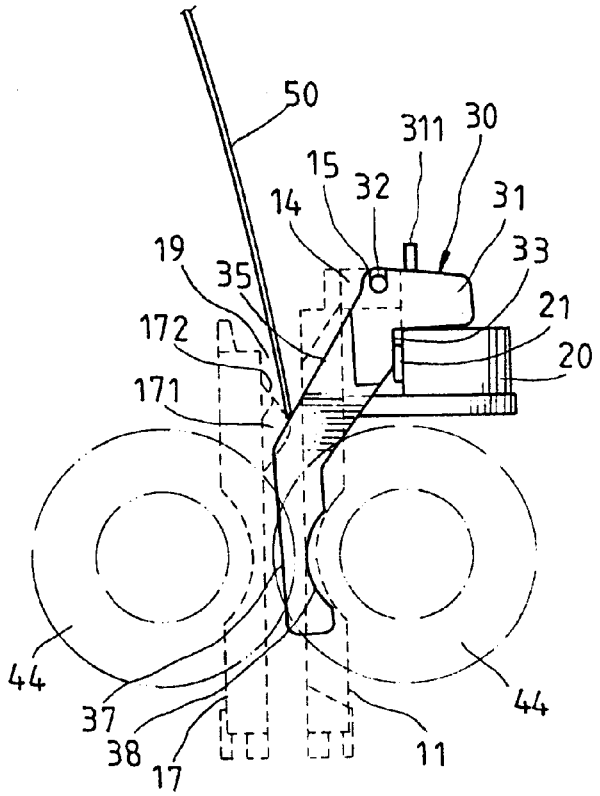
FIG. 5 is a schematic view showing that the detecting rod of the present invention is pushed by the paper that has been fed thereinto.
Figure 6:
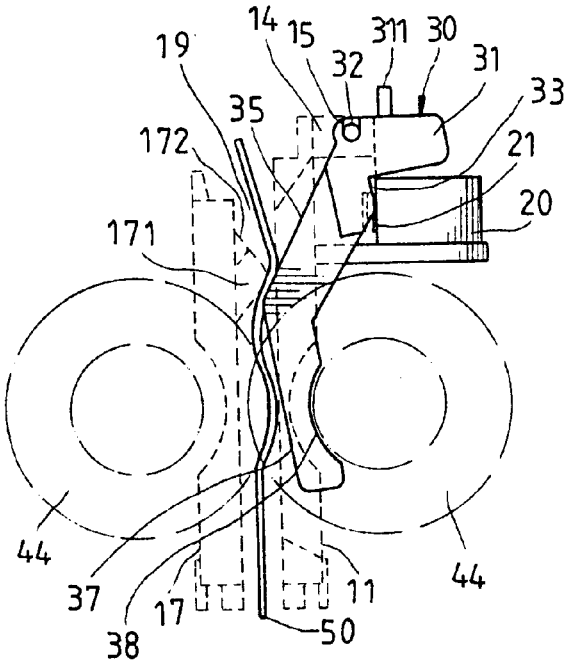
FIG. 6 is a schematic view showing the position of the detecting rod of the present invention at the time when the paper passes two shredding tools.

As shown in FIG. 4, when a paper 50 has not been fed into the paper entry 42, the vertical portion 37 is located in the middle of the shaft gap of the two shredding tools 44. Now referring to FIG. 5, after the paper 50 has been fed into the paper entry 42, the front edge of the paper 50 is guided by the inclined surface 172 of the guide portion 171 to slide down to the surface of the detecting rod 30. The detecting rod 30 is thus pushed by the paper to swivel toward the first paper guiding grid plate 11, thereby resulting in the microswitch 20 being triggered by the detecting rod 30. As a result, the two shredding tools 44 are activated to bring the paper 50 continues moving down to be between the two shredding tools 44, the paper 50 is shredded by the two shredding tools 44 in operation. At this moment, the swiveling angle of the detecting rod 30 is greatest. As shown in FIG. 7, when the paper 50 has completely moved through the shredding tools 44 such that the paper 50 is about to separate from the detecting rod 30, The detecting rod 30 still remains in the state of being pushed so as to keep the two shredding tools 44 in the operating state to ensure that the paper 50 is completely shredded. As a result, the detecting rod 30 is no longer pushed. In the meantime, the contact button 21 of the microswitch 20 actuates the detecting rod 30 to return to remain in its original state as shown in FIG. 4. The shredding action of the two shredding tools 44 is thus interrupted.

In the event that the rear end of the paper 50 is not shredded, the operator may dial the dialing block 311 to cause the detecting rod 30 to effect the swiveling action described above, so as to trigger the microswitch 20 to activate the two shredding tools 44.

It is therefore readily apparent that the present invention has advantages over the prior art. In the first place, the present invention is relatively simple in construction and cost-effective. The present invention is free from the electronic circuit which is expensive and susceptible to the environmental interference. The present invention is mechanically operated and is therefore relatively reliable.

What is claimed is:

1. A device for monitoring a paper shredding action of a paper shredder, said device located under a paper entry of the paper shredder and comprising:

two paper guiding grid plates mounted in a base of the paper shredder such that said two paper guiding grid plates form therebetween a paper guiding passage for guiding a paper sheet to move from the paper entry into two shredding tools of the paper shredder, a first paper guiding grid plate of said two paper guiding grid plates provided with a fastening seat extending therefrom and having a recess in communication with said first paper guiding grid plate and said paper guiding passage;

a microswitch mounted on said fastening seat and provided with a contact button corresponding in location to said recess; and a detecting rod extending via said recess between said two paper guiding grid plates such that said detecting rod is fastened pivotally at a top edge of said recess, and that said detecting rod is immediately contiguous to said contact button of said microswitch, and further that a free end of said detecting rod is located under a lower end point of an intersection surface of the two shredding tools of the paper shredder.

2. The device as defined in claim 1, wherein said recess of said fastening seat is provided with two receiving slots located at two sides thereof; and wherein said detecting rod is provided at said one end thereof with two lugs, which are received in said two receiving slots.

3. The device as defined in claim 1, wherein said detecting rod has an inclined portion and a vertical portion extending from said inclined portion, said inclined portion being located in said recess of said first paper guiding grid plate, said vertical portion being located in said paper guiding passage.

4. The device as defined in claim 3, wherein said vertical portion is provided with an arcuate surface opposite in location to said first paper guiding grid plate.

5. The device as defined in claim 3, wherein a second paper guiding grid plate of said two paper guiding grid plate has a guide portion, which is separated from said inclined portion of said detecting rod by a distance.

6. The device as defined in claim 5, wherein said guide portion is provided with an inclined plane corresponding in location to one side of a top end opening of said two paper guiding grid plates.

7. The device as defined in claim 1, wherein said detecting rod is provided with a press surface corresponding in location to said contact button such that said press surface comes in contact with said contact button to trigger said microswitch at such time when said detecting rod is pushed to swivel.

8. The device as defined in claim 1, wherein said detecting rod is provided at said one end thereof with a dialing block which is jutted out of a through hole of the top side of the seat of the paper shredder.

* * * * *